US007833117B2

(12) United States Patent
Tiura

(10) Patent No.: US 7,833,117 B2
(45) Date of Patent: Nov. 16, 2010

(54) HANDLE WITH AIR CONDITIONING SYSTEM FOR RACKET, PADDLE OR TOOL

(76) Inventor: Oliver Tiura, 50 Etta Wylie Rd. Unit 503, Toronto, Ontario (CA) M8V 3Z7

( * ) Notice: Subject to any disclaimer, the term of this patent is extended or adjusted under 35 U.S.C. 154(b) by 99 days.

(21) Appl. No.: 12/376,213

(22) PCT Filed: Jul. 31, 2007

(86) PCT No.: PCT/CA2007/001350

§ 371 (c)(1),
(2), (4) Date: Feb. 3, 2009

(87) PCT Pub. No.: WO2008/014608

PCT Pub. Date: Feb. 7, 2008

(65) Prior Publication Data

US 2009/0264228 A1 Oct. 22, 2009

Related U.S. Application Data

(60) Provisional application No. 60/835,425, filed on Aug. 4, 2006.

(51) Int. Cl.
*A63B 49/08* (2006.01)

(52) U.S. Cl. ..... 473/550; 473/549

(58) Field of Classification Search ..... 473/549, 473/550, 552, 554; D21/729–731; 16/110.1, 16/430
See application file for complete search history.

(56) References Cited

U.S. PATENT DOCUMENTS 2,086,062 A 7/1937 Bray
2,120,280 A 6/1938 Hall
2,205,578 A 6/1940 Schnur
3,489,031 A 1/1970 Meier
4,082,276 A 4/1978 Szafianski
4,108,436 A 8/1978 Masi
4,139,195 A 2/1979 Dreesen et al.
4,174,109 A 11/1979 Gaiser
4,407,500 A 10/1983 Hofmann
4,907,810 A 3/1990 Whiteford
4,984,793 A 1/1991 Chen
5,018,733 A 5/1991 Buand
5,131,652 A 7/1992 Peng
5,269,516 A 12/1993 Janes
5,374,059 A 12/1994 Huang
5,397,123 A 3/1995 Huang
5,669,835 A 9/1997 Tiura
5,897,448 A 4/1999 Chang (Continued)

FOREIGN PATENT DOCUMENTS

DE 2819174 11/1979
DE 3225481 1/1984

(Continued)

*Primary Examiner*—Raleigh W. Chiu
(74) *Attorney, Agent, or Firm*—Brooks Kushman P.C.

(57) ABSTRACT

A striking device such as a racquet or tool has a head portion for striking an object and an elongate handgrip with an exterior shell defining an elongate ventilation chamber having a set of air holes for ventilation purposes and to create enhanced gripping ability. An air scoop section is connected to a head end of the shell and forms two air inlets on opposite sides of the handgrip. The air scoop section includes a partition separating the two air inlets, this partition having airflow directing surfaces on opposite sides thereof. These surfaces can direct outside air in a longitudinal direction into the ventilation chamber.

20 Claims, 7 Drawing Sheets

U.S. PATENT DOCUMENTS

| | | | | |
|---|---|---|---|---|
| 6,149,538 | A * | 11/2000 | Tiura | 473/550 |
| 6,558,270 | B2 * | 5/2003 | Kwitek | 473/301 |
| 2009/0264228 | A1 * | 10/2009 | Tiura | 473/550 |

FOREIGN PATENT DOCUMENTS

| | | | |
|---|---|---|---|
| DE | 3413600 | | 8/1985 |
| DE | 3625929 | | 2/1988 |
| DE | 3634907 | | 4/1988 |
| DE | 8803210 | | 4/1988 |
| DE | 4339133 | | 7/1994 |
| FR | 2569567 | | 3/1986 |
| FR | 2569567 | A1 * | 3/1986 |
| FR | 2596994 | | 10/1987 |
| FR | 2623092 | A1 * | 5/1989 |
| GB | 1510626 | | 5/1978 |
| JP | 09038242 | A * | 2/1997 |
| WO | 98/55270 | | 12/1998 |

* cited by examiner

HANDLE WITH AIR CONDITIONING SYSTEM FOR RACKET, PADDLE OR TOOL

The present invention is directed to striking devices such as a racquet, paddle or striking tool, these devices including a head portion for striking an object or surface and an elongate handgrip connected to the head portion and to a handle assembly for such a striking device and is also directed to flexible strips for forming elongate handgrips.

The use of tennis, squash, racquetball, badminton, table tennis, paddle ball, jai alai, rackets, scoops and paddles, and hand tools such as various types of hammers (claw, ripping, finishing, ball pein, soft face, tack, brick, drywall, shingling, mallets, etc.), picks, various hatchets and axes, and other striking devices requires substantial physical exertion of a user during the course of activity associated with the striking device. Usually, this results in profuse perspiration, especially of the holding hand. As a result, it is often difficult for a user to hang onto and maintain control of the striking device as the build up of perspiration can result in a significant reduction of friction between the user's hand and the grip of the handle. During use, even the handle structure begins to warm up and retain accumulated heat, which further exacerbates the problem. Occasionally, a player, worker or user may find that the combination of heat, perspiration and contact with the handle can result in blistering and inflammation of the skin of his or her hand. During use of the racket or striking device, the hand, arm and elbow of a user's arm is repeatedly subjected to a jarring shock each time the striking device impacts against an object. The repetitive shock being applied to the user can, and often does, result in injury to the muscles and tendons of the hand, arm or elbow of the user.

In the prior art, various handle designs have been disclosed with ventilation and shock absorbing features but, for various reasons, none have proved to be particularly successful in practice. For example, U.S. Pat. No. 4,907,810 issued May 13, 1990 to C. L. Whiteford discloses a ventilated and shock absorbing racket handle construction comprised of a rigid tubular shell having a large number of small holes in its surface area and a handle shank mounted in the shell. Air passages are provided between the handle shank and the shell and air can enter these passages through the holes contained in the shell. The shell is wrapped with a leather member also containing a series of holes. However, the racket handle in the Whiteford patent relies on random alignment of the holes in the leather wrapping member and the holes in the shank member which often results in few holes in the shell being left open. Furthermore, it is believed that the air passageways and small holes disclosed in the Whiteford patent are not sufficient enough to result in the air flow required to satisfactorily cool a user's hand.

U.S. Pat. No. 5,018,733 issued May 28, 1991 to T. M. M. Buand discloses a handgrip for a racket for ball games that includes a narrow ventilation chamber formed between the body of the handgrip and a sleeve surrounding the grip. However, the outer sleeve is flexible, resulting in the volume of the narrow chamber being varied by the pressure exerted by a player's hand. Again, the construction is such that the airflow in the grip will be insufficient to cool a user's hand or satisfactorily absorb shock.

In applicant's issued U.S. Pat. No. 6,149,538 dated Nov. 21, 2000 there is disclosed an elongate handle for a striking device such as racquet or hammer. The handle has a handgrip with a central body having concavely curved front and rear surfaces which extend a substantial distance along the handgrip. The handle further includes an exterior shell disposed on opposite sides of the central body and covering its front and rear surfaces. The shell has a set of air passages for ventilation formed therein that communicate with two separate ventilation chambers that are formed between each of the front and rear surfaces and the shell. Two air inlets are formed on opposite sides of the handgrip at a head end, each air inlet opening into a respective one of the ventilation chambers at the head end.

Despite the cooling capabilities of the handle for a striking device disclosed in applicant's U.S. Pat. No. 6,149,538, certain deficiencies in this known handle design have become apparent and the present disclosure provides an improved handle design which overcomes one or more of these deficiencies. In particular, in the known handle design, the size and configuration of the air scoops at the head end of the handgrip were deficient. In particular the angle of orientation of the air scoops was found to not be the best orientation for directing outside air into the ventilation chambers formed in the handle. Both the relatively small size of the air scoops and the method by which these known scoops directed air into the interior of a handle resulted in a ventilation capability which was less than desired, and resulted in an incomplete cycling of external air to the user's palm. Additionally, the number and size of the air passages formed in the shell did not provide maximum air circulation to the palm. Also this known handle construction for a striking device did not adequately absorb vibrations when the striking device actually struck an object such as a ball, nail or piece of wood.

The striking device handle of the present disclosure is provided with air inlets or air scoops, a ventilation chamber and air passages opening into this ventilation chamber which in combination are able to very effectively capture and direct external air to a user's hand during use of the striking device. Further, according to a disclosed embodiment which employs an enlarged air scoop section at the head end of the shell that forms the handgrip, this striking device handle has an improved capability of absorbing the impact that occurs when an object or surface is hit by the striking device.

According to one embodiment of the invention, a striking device comprises a head portion for striking an object or surface and an elongate handgrip connected to the head portion. The handgrip includes an elongate exterior shell having a central longitudinal axis, having a plurality of air holes formed therein for ventilation, and defining an elongate ventilation chamber. The air holes extend between the ventilation chamber and an exterior surface of the shell. An air scoop section is connected to a head end of the shell and forms two air inlets on opposite sides of the handgrip and on opposite sides of a central longitudinal plane. Each air inlet opens into a respective air passage connected to the ventilation chamber at the head end thereof. The air scoop section includes a partition separating the two air inlets and the air passages, this partition having airflow directing surfaces on opposite sides thereof which, during use of and movement of the striking device, can direct outside air in a longitudinal direction of the handgrip into the ventilation chamber. Each airflow directing surface has a substantially planar central section which slopes at an acute angle to the central longitudinal plane when said central section is viewed in transverse cross-section of the air scoop section.

In a particular exemplary embodiment of this striking device, the air scoop section includes two pairs of longitudinal side walls with each pair defining one of the air inlets and its respective air passage. One side wall of each pair has a height extending perpendicular to the central longitudinal plane greater than the height of the other side wall of the pair.

According to another embodiment of the invention, a ball hitting device for a ball game such as tennis or paddle ball has a relatively wide and flat head portion extending in a first plane and an elongate, hollow handgrip connected to the head portion and having a central longitudinal axis. This handgrip comprises an elongate, exterior shell extending lengthwise along the central longitudinal axis, having a plurality of air holes for ventilation distributed over an exterior surface thereof, and forming and surrounding an elongate ventilation chamber. The air holes extend between the ventilation chamber and the exterior surface. An air scoop section extends between and is rigidly connected to one end of the shell and to the head portion and forms two air inlets on opposite sides of the handgrip and on opposite sides of a central longitudinal plane which is substantially coplanar with the first plane. The air scoop section also forms two air passages connected to the ventilation chamber and extending between a respective one of the air inlets and the ventilation chamber. The air scoop section includes a partition separating the air passages and having airflow directing surfaces on opposite sides thereof to direct outside air into the ventilation chamber during use of the device. Each airflow directing surface has a substantially planar central section which slopes at an acute angle to the central longitudinal plane when the central section is viewed in transverse cross-section of the air scoop section.

According to a further version of the invention, a flexible strip for forming an elongate handgrip of a striking device comprises a major strip portion having opposite first and second end edges and opposite first and second side edges with the first side edge extending between the first and second end edges at an acute angle to the first end edge and the second side edge extending from one end of the first end edge a major portion of the distance between the first and second end edges towards the second end edge and at an acute angle thereto. A minor strip portion is connected to a corner of the major strip portion located where an end of the second side edge is closest to the second end edge. The minor strip portion has two opposite, curved side edges extending away from said corner and generally parallel to one another. These curved side edges include a convex outer side edge that extends from about the second end edge of the major strip portion and that curves towards a straight line extension of the first end edge. The flexible strip is adapted for wrapping around a rigid, elongate handgrip support having an enlarged butt end and, when applying the strip to the handgrip support, the minor strip portion is wrapped around the butt end.

An exemplary embodiment of the aforementioned flexible strip when wrapped on the handgrip support is able to provide a smooth transition between the sides of the butt section and the sides of the main portion of the handgrip support which extend at an obtuse angle to one another.

According to still another embodiment of the invention, a flexible, plastic grip member for making an elongate handgrip of a striking device comprises an elongate, open-ended sleeve member made of heat shrinkable plastics material and sized to fit loosely around a rigid, elongate handle support having an enlarged butt end. The sleeve member has a longitudinal central axis, a main section extending a major portion of the length of the sleeve member, and a relatively short end portion formed of a circumferentially extending sleeve wall section which, in axial cross-section of the sleeve member, slopes at an acute angle to the longitudinal central axis.

These and other aspects of the disclosed striking devices, handles for striking devices, and flexible strips and grip members for forming handgrips will become more readily apparent to those having ordinary skill in the art from the following detailed description taken in connection with the drawings provided herewith.

So that those having ordinary skill in the art to which the present disclosure pertains will more readily understand how to make and use the subject invention, exemplary embodiments thereof will be described in detail herein below with reference to the drawings, wherein.

Figure 1:
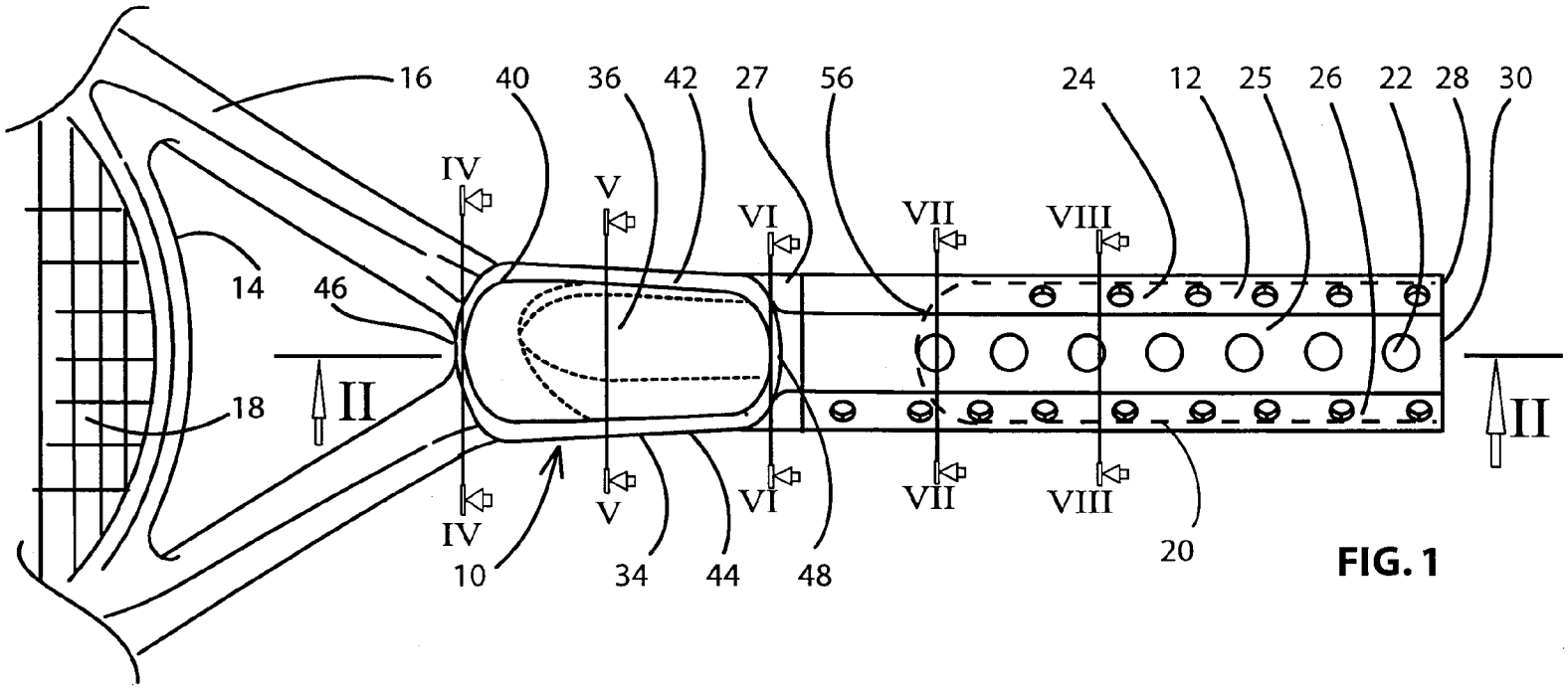
FIG. 1 is a front view of a tennis or badminton racquet, this view showing the racquet handle, a portion of the head of the racquet and the throat area that connects the head to the handle.
Figure 9:
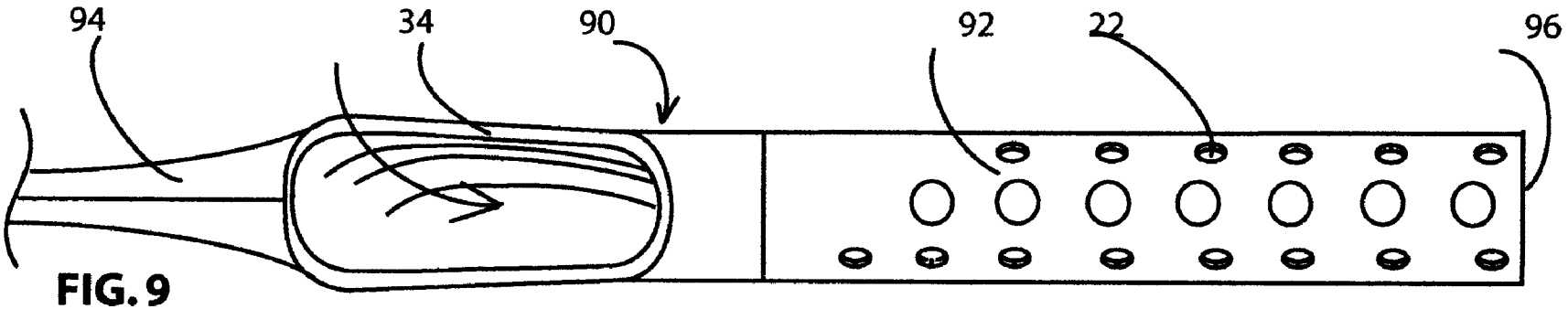
FIG. 9 is the front view of a handle for a striking device such as a hammer, hatchet or axe.
Figure 10:
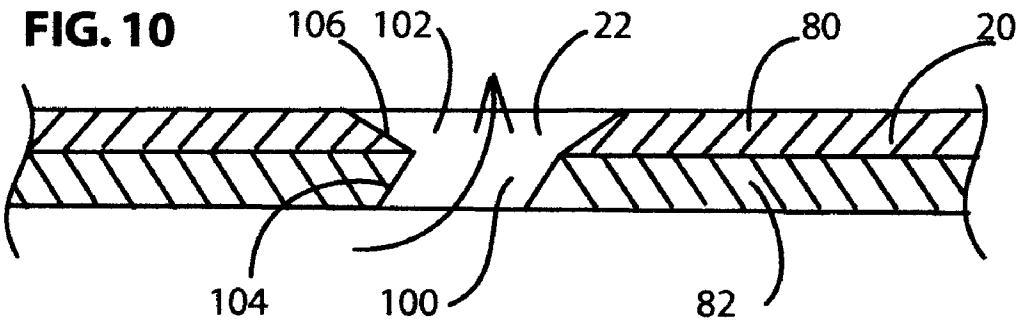
FIG. 10 is a detailed cross-sectional view showing the sloping walls that form a single opening in the shell.

Illustrated in FIG. 1 is one embodiment of a striking device, in this case a tennis, squash, racketball or badminton racquet (10), constructed according to one embodiment of the present invention. This view shows only a small portion of the head of the racquet. It should be understood that the head portion of the racquet can be of standard construction and accordingly a detailed description herein is deemed not to be necessary. The racquet, one form of ball hitting device, has a relatively wide and flat head portion extending in a first plane which is coplanar with a central longitudinal plane indicated at A in FIG. 2. The racquet (10) has an elongate, hollow handle or handgrip (12) which can be connected rigidly to the head (14) of the racquet by means of a throat section (16) constructed in the form of a V, if desired. The head portion is designed to strike a tennis ball with its strings (18). The handgrip (12) has a central longitudinal axis and includes an elongate exterior shell (20) which can be made of two layers of material as illustrated in FIG. 10 and as described in more detail hereinafter. The shell extends lengthwise along the central longitudinal axis and has a plurality of first air holes (22) for ventilation formed therein. These air passages are larger than the ventilation openings used in applicant's prior handles for striking devices (disclosed in U.S. Pat. No. 6,149,538 issued in November 2000) and they are aligned in straight rows extending the length of the shell. The shell can be multi-sided as shown, for example having eight longitudinally extending sides such as sides 24 to 26, or the shell can be ovoid in transverse cross-section as shown in FIG. 9. The air holes or passages (22) can be distributed evenly over all of the sides of the shell. The air holes (22) should be sufficiently large, preferably in the range of 5 to 9 mm in diameter, depending on the racquets, paddles, or tools in which they are formed to permit good airflow from the interior of the shell to the user's hand. The shell has a first end (27) and a second end (30) and defines an elongate ventilation chamber (28). The second end is located furthest from the head portion of the striking device. This chamber is optionally closed at the second or butt end (30) by a butt end wall so there is no air flow through this end but it is also possible for the end 30 to be open completely or partially. If desired, the butt end of the handle can be covered by an optional butt cap (32) which can be bonded by adhesive or attached by staples to the shell. The air holes (22) extend between the ventilation chamber 28 and the exterior surface of the shell.

Figure 2:
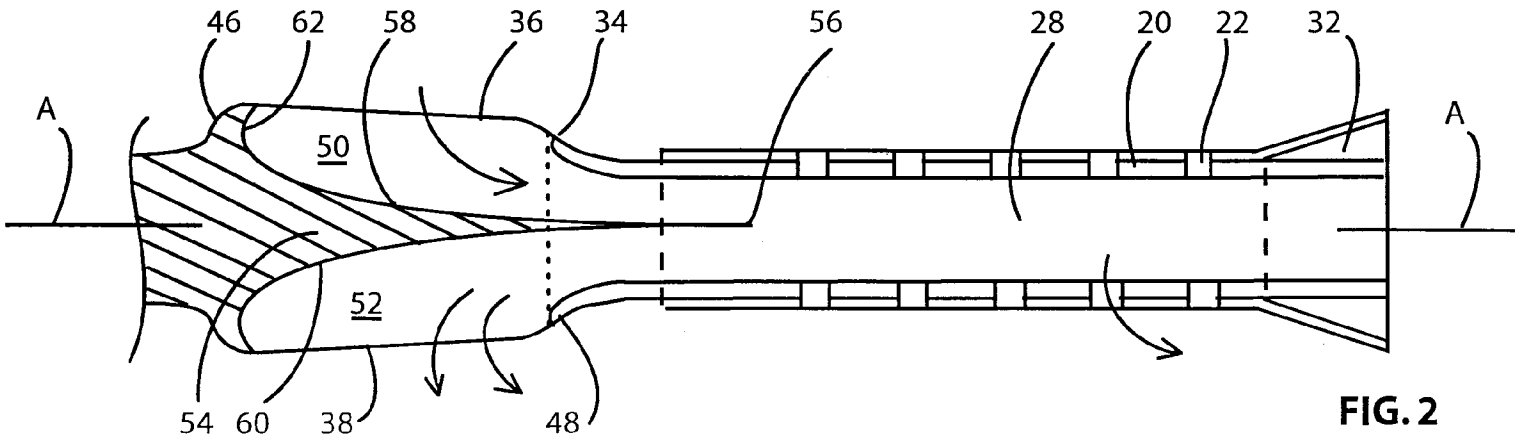
FIG. 2 is a schematic cross-sectional view of the racquet handle of FIG. 1, this view being taken along the centerline II-II of FIG. 1.

The handle or handgrip of the striking device also has an air scoop section (34) connected to the head end of the shell (20) and the head portion of the device and forming two air inlets (36, 38) on opposite sides of the handle and on opposite sides of the central longitudinal plane indicated by the line A in FIG. 2. Each opening is surrounded by a lip (40) which can include two, straight lip sections (42, 44) located on opposite sides of the inlet and rounded end sections (46, 48). The end sections (46, 48) can be of equal size or, if desired, the head end section (46) can be slightly larger than the opposite end as shown in FIG. 1. It should be appreciated that the greater depth of the air scoop section (34) formed by the walls extending between the inlets (36, 38) helps to reduce or eliminate the passage of vibrations to the handgrip and the user's hand when a ball (or other object) is struck. The plane in which each air inlet extends can be parallel to the central longitudinal plane A or at a small acute angle thereto as shown in FIG. 2. As illustrated, the end section (46) projects slightly further from the plane A than the opposite end section (48). The purpose of this angle is to improve the angle of attack of each air scoop as it moves through the air when the striking device is used, thereby improving air intake.

Each air inlet opens into a respective air passage (50, 52) which is formed in the air scoop section and is connected to the ventilation chamber (28). The air scoop section includes a partition (54) which separates the two air inlets and their respective passages. This partition or air director extends to a thin edge (56) and this thin edge can either be a straight edge extending transversely of the handgrip or can form a concave curve as indicated in dash lines in FIG. 1. It will thus be seen that the partition (54) defines part of the air scoop on each side of the handle in the scoop section (34). As seen in the longitudinal cross-section of FIG. 2, the partition forms airflow deflecting surfaces (58, 60) located on opposite sides thereof which, during use of the racquet or striking device, can direct outside air in a longitudinal direction of the handgrip into the ventilation chamber (28). As seen in longitudinal cross-section, each deflecting surface, (58, 60) provides a scoop floor which forms a gentle concave curve. This gentle curve can extend to a concave inner wall section (62) having a shorter radius of curvature and extending to the end of the lip (46).

Figure 3:
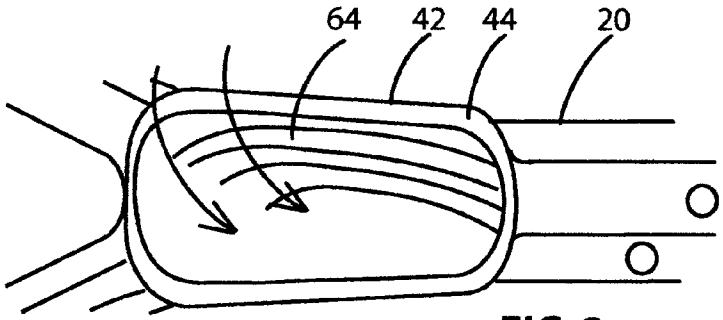
FIG. 3 is a detailed view of the scoop section of the racquet handle of FIG. 1, this view showing the rough surface on an inner, transversely sloping 5 surface of the scoop.
Figure 11:
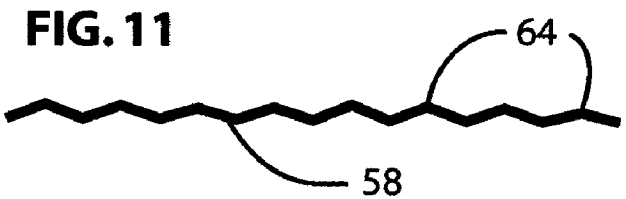
FIG. 11 is a schematic detail view showing one form of textured surface that can be provided on the surface of the air scoop of the handle.

FIG. 3 of the drawings illustrates how the floor of each scoop or the deflecting surface (58, 60) can optionally have an overall rough or bumpy surface or be formed with ridges (64). One possible form of the ridges is indicated schematically in FIG. 11 where the ridges extend generally longitudinally of the handle. It is also possible to construct each deflecting surface so that the ridges extend generally transversely of the handle. The ridges can be of the same size and extend generally parallel to each other, this textured surface helps prevent air flow through the passage from "sticking" to the deflecting surface (58, 60), thereby allowing a greater flow of air into the handle.

Figure 5:
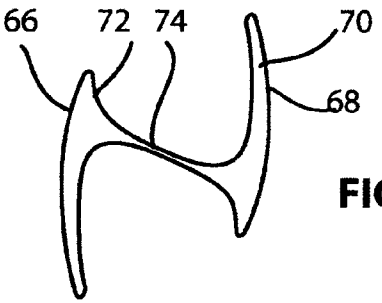
FIG. 5 is another transverse cross-section of the scoop section, this cross-section being taken along the line V-V of FIG. 1.
Figure 4:
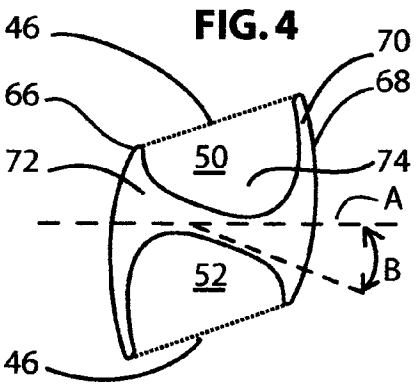
FIG. 4 is a transverse cross-section of the scoop section, this view being taken along the line IV-IV of FIG. 1.

FIGS. 4 to 8 show various transverse cross-sections taking through scoop section (34) and through the shell (20). The cross-section of FIG. 4 is taken near the head end of the scoop section and shows how opposite exterior sides (66, 68) of the air scoop section are convexly curved. There are a pair of longitudinal side walls on opposite sides of each air passage (50, 52). Each pair defines a respective one of the air inlets and its respective air passage. One side wall of each pair has a height extending perpendicular to the central longitudinal plane indicated at A which is greater than the height of the other side wall (72) of the pair. The interior surface of each of these side walls can also be concave curves as shown. In other words, the interior surface of the wall is concavely curved as viewed in a transverse cross-sectional plane perpendicular to the central longitudinal axis. Not shown in these transverse cross-sections is the textured surface of each air scoop for ease of illustration. Also visible in both FIGS. 4 and 5 is a substantially planar central section (74) of each airflow deflecting surface. It will be seen that this central section slopes at an acute angle β to the central longitudinal plane A when the central section is viewed in transverse cross-section of the air scoop section. Thus in this region of the air scoop and the region illustrated by FIG. 5 the air scoop is deeper on one side than it is on its other side. This slope of the deflecting surface forming the floor of each air scoop allows greater air capture by the swinging movement of the racquet or other striking device as compared to the air scoop arrangement described and illustrated in applicant's issued U.S. Pat. No. 6,149,538.

FIG. 5 shows the transverse cross-section of the air scoop section (34) about midway along its length. At this location, the exterior surfaces of the section continue to be convex curves. However, the one sidewall (70) has an increased height as compared to the cross-section of FIG. 4. The opposite sidewall (72) is still substantially shorter than the wall (70) but can be slightly greater in height than the same wall at the location of the cross-section of FIG. 4. One reason for the increased depth of the air scoop is that the planar central section (74) is thinner at this location. The change in the thickness of the central section results from the deflecting surfaces (58) and (60) sloping towards the ventilation chamber (28). At this location, the intake space of the air scoop is enlarged.

Figure 6:
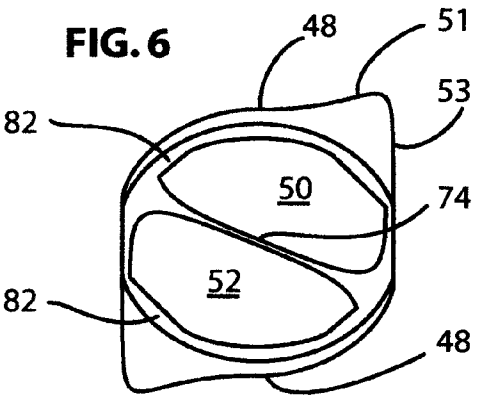
FIG. 6 is a further transverse cross-section taken along the line VI-VI of FIG. 1.

Turning to the cross-section of FIG. 6, this cross-section is taken at the end of the air scoop section adjacent the shell (20). At this point, the two air passages (50, 52) are enclosed about their circumferential perimeters. The planar central section (74) is still quite thin and extends transversely at the same acute angle to the central longitudinal plane A. The exterior shell around the air passages has a transitional shape in this cross-section. The curved exterior surfaces in this part of the scoop section are still able to capture and divert outside air into the air passages (50, 52) and the ventilation chamber (28). The exterior surfaces curve outwardly at 51 to accomplish this improved air intake.

Figure 8:
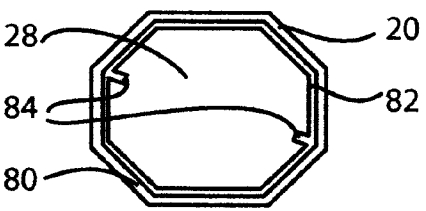
FIG. 8 is another transverse cross-section of the handgrip, this view being taken along the line VIII-VIII of FIG. 1.
Figure 7:
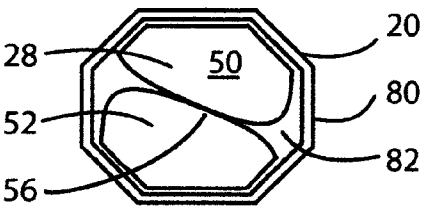
FIG. 7 is a transverse cross-section of the exterior shell of the handgrip, this view being taken along the line VII-VII of FIG. 1.

In the cross-section of FIG. 7 taken through the open region of the ventilation chamber (28), the multi-sided exterior surface of the shell (20) can be seen. This view also looks into the separated air passages (50, 52) and there is shown the thin edge (56) of the partition. The air holes (22) in the shell have been omitted from FIG. 7 and FIG. 8 for ease of illustration. Both FIGS. 7 and 8 illustrate that the shell (20) can be made of two layers. An exterior layer (80) of the shell can, for example, be a flexible, resilient plastic, a dense foam urethane, or other gripping material and the air holes (22) formed therein are mechanically aligned with similar sized air passages or apertures in a rigid underlying support layer or support structure (82). The alignment of the holes in the layers 80 and 82 can occur in several ways. One manufacturing method utilizes laser cutting of both layers together with immediate compression at a suitable elevated temperature to the required form. In the case of replacement grips, the grips can first be templated then cut separately, aligned to a registration mark, and then placed on the formed support layer or structure. The support structure of the shell as well as the air scoop section (34) can be made of any one of a wide variety of strong, durable materials, including various metals such as aluminum or titanium alloy, strong composite plastics, carbonates, carbon fiber materials and even suitably strong, structurally strengthened woods. Alternatively, a variety of known stable materials in fine powder form can be combined in a known manner with carbon/graphite mixtures to produce the structural layer (82) of the handle. Although it is possible to construct the support layer (82) and the air scoop section using a number of separate components or pieces, an exemplary form of this assembly is constructed from a single piece of material by a molding or other process, with the particular process selected depending upon the actual material used and the exact configuration desired.

An optional additional feature to assist directional airflow illustrated in FIG. 8 is the use of internal ribs (84) that extend longitudinally along the interior of the shell and that can, for example, be located on opposite sides of the shell.

If desired, the flexible exterior layer (80) can be bonded by a releasable adhesive to the support structure (82) or, alternatively, it can be permanently bonded to the support layer. Increased adherence between the exterior layer (80) and the underlying layer or structure can be provided by having the exterior skin or exterior layer project slightly into each of the air holes (22) or many of these air holes. This embedding of the outer layer can be accomplished during the step of mechanically forming the aligned holes or air passages (22) in the exterior layer, for example, by a mechanical punching process or heat pressing process.

FIG. 9 illustrates one embodiment of a handle (90) suitable for use as the handle of a striking device such as a hammer, hatchet or axe. Unlike the racket handle of FIGS. 1 and 2, this handle can have a rounded or curved, transverse cross-section through the length of its exterior shell (92). This handle also has an air scoop section (34) which can be similar in its construction to the air scoop section of the handle shown in FIGS. 1 and 2. Projecting forwardly from this air scoop section is a connecting shank (94) which is connected to the head of the hammer or hatchet, this head not being shown in the figure. The butt end (96) of the handle (90) can either be completely closed, completely open or can be partially covered. The amount that the butt end is open affects the amount of air flowing through the shell of the handle and can affect the amount of cooling air passing through air passages (22). Also, in a manner similar to the racket handle, the shell (92) can be constructed of two layers of material which the outer layer being made of a flexible material such as a suitable plastics material or leather. The flexible outer layer helps to absorb the effect of the impact force of the device on an object such as a nail or a block of wood. This layer can be molded, dipped or sprayed, onto the inner structure or it can be constructed from an elongate strip that is wrapped onto the handle. For purposes of a striking device such as a hammer or axe, it is particularly important that the underlying material be made of a strong, rigid material such as a suitable metal or a strong composite plastic which can be reinforced with carbon fibers.

FIG. 10 is a detail view in the form of a longitudinal cross-section illustrating a single hole in the exterior shell 20 or 92. As indicated, this exterior shell is constructed with an exterior layer (80) and an underlying support layer (82) which provides a handle support structure. The layer (80) in an exemplary embodiment can be made of flexible, resilient plastic or a dense urethane foam. A exemplary hole (22) has a hole section (100) extending through the support layer (82) as well as a hole section (102) that extends through the exterior layer (80). The center axis of the hole section (100) extends at an angle to the longitudinal centerline of the hand grip in this exemplary embodiment. The cylindrical wall (104) slopes at the same angle and thus this hole section slopes inwardly towards the head of the racket or the head of the striking device. The slope of hole section (100) provides smooth streaming of the airflow from inside the shell to a user's hand. On the other hand, the annular wall (106) of hole section (102) can slope outwardly as shown from the center of this hole section so as to allow maximum contact between the surface of the user's hand and the air passing through opening (22) or circulating in this opening.

Figure 12:
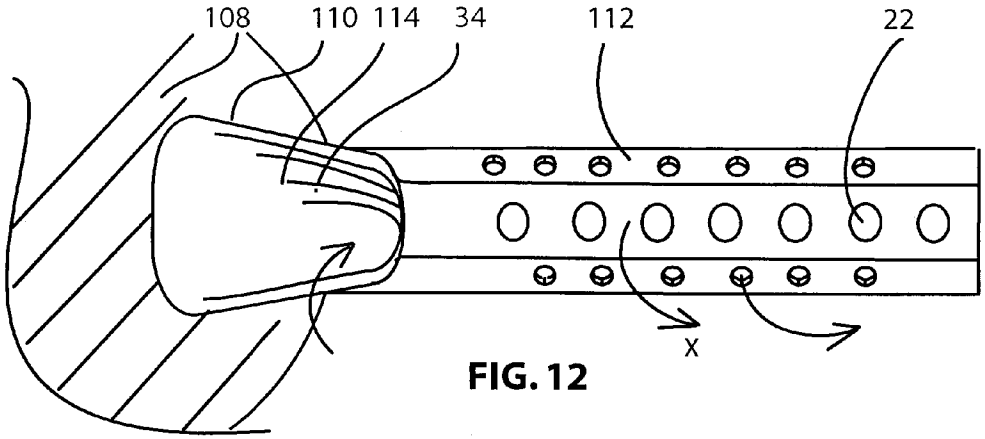
FIG. 12 is a front view of another embodiment of a striking device with an air scoop having an approximately triangular shape, this device being a paddle with only a portion of the paddle head being shown.
Figure 13:
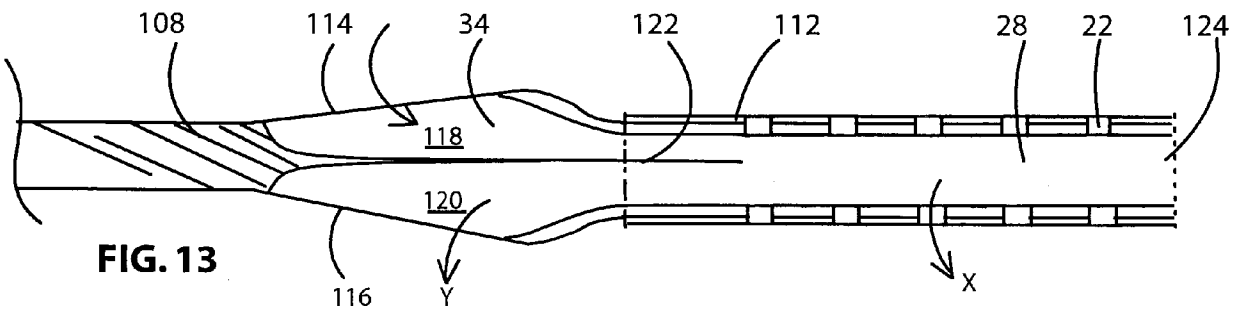
FIG. 13 is a longitudinal cross-section similar to the cross-section of FIG. 2 but showing a cross-section of the device of FIG. 12.

FIG. 12 is a view illustrating the use of one form of handle according to the present disclosure for a paddle such as a paddle used in table tennis or platform tennis. Only a portion of the flat paddle section of the paddle (108) is illustrated in FIG. 12. As the handle used in a table tennis paddle is generally quite short (compared to a tennis racket handle), the air scoop section (34) of the handle is connected directly to the flat paddle section of the paddle (108). In the illustrated embodiment, the handle, the scoop section (34) and the paddle (108) are formed integrally and this can be done, for example, by a suitable molding process. FIG. 12 also shows the air scoop section integrally connected to the paddle section on three sides of the air scoop section. It is also possible to construct the handle with or without the air scoop section and the flat portion of the paddle as separate members and then to rigidly attach these members by adhesive or a mechanical type connection. As in the embodiment of FIGS. 1 and 2, there are two air inlets 114 and 116 which respectively lead to air passages (118, 120). The air inlets and the air passages are separated by a central partition (122) which can also be described as an air director. It will be appreciated that the partition (122) is constructed in a manner similar to the partition (54) of the first embodiment and is in particular angled in the transverse direction. However, in plan view, the partition (122) has a generally triangular or flared shape since it widens substantially towards the paddle end. The ventilation chamber (28) in the shell (112) is substantially an open chamber, except for the presence of the partition in the forward end thereof. As shown, the shell section (112) has an open butt end (124) to allow air flow through this end but it is also possible to construct the handle with a closed butt end or a butt end that is only partially open, thereby restricting air flow through this end. The arrows X in FIGS. 12 and 13 indicate air flow that has entered into the ventilation chamber through the air inlets and is escaping through air passages (22) that are distributed about the circumference of the multi-sided handle and along its length. Also, FIGS. 12 and 13 show air entering the handle through air inlet (114) (which would occur if the paddle is being swung upwardly as seen in FIG. 13) and shows air being sucked out concurrently through the other air inlet 116, this being indicated by the arrow Y. It will be appreciated that positive air pressure is created at the leading air scoop while a negative air pressure (or suction) is created at the opposing or trailing air scoop.

Figure 14:
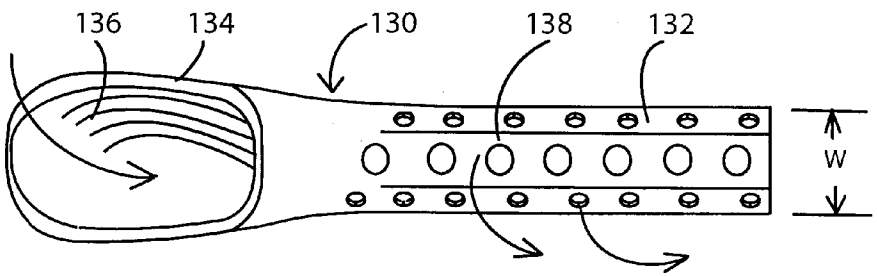
FIG. 14 is a front view of another embodiment of a handle for a striking device, this handle having an ovoid air scoop having a width greater than the adjacent elongate handle shell.

Another embodiment of a handle according to the present disclosure is illustrated in FIG. 14. This handle or handgrip (130) includes a multi-sided shell section (132) which can be similar in its construction to the shell section of the racket of FIGS. 1 and 2. At the head end of this shell section is a scoop section (134) having two air inlets (136), only one of which can be seen. In this embodiment, the scoop section (134) has an ovoid air scoop on each side which is larger than the width of the handle indicated at W. In fact, the air scoop section (134) in this embodiment can be wider than the exterior shell (132) both in the transverse direction (shown in FIG. 14) which is parallel to the central longitudinal plane of the handle (corresponding to the plane A in the handle of FIGS. 1 and 2) and in the second transverse direction perpendicular to this central longitudinal plane. Thus, in this embodiment the air inlets (136) are at least as wide, if not wider, than the exterior shell (132) and project further from the central longitudinal plane than adjacent sides (138) of the exterior shell. By making the air scoop larger in this manner and, in particular, by making the air inlets (136) larger, the ability of the air scoop section to draw or pull air into the shell of the handle is enhanced.

Figure 15:
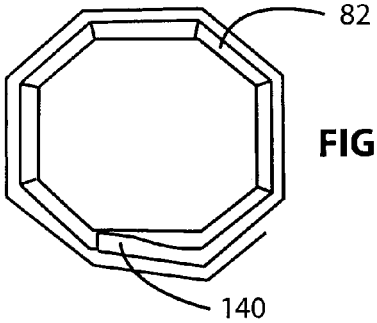
FIG. 15 is a schematic end view of the butt end of one form of the handgrip, this view showing an indentation used to start the wrapping of the flexible strip for the handgrip at the correct location.
Figure 16:
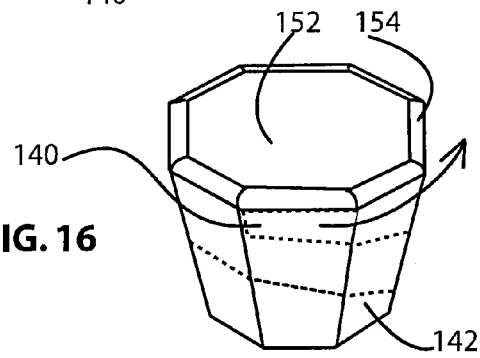
FIG. 16 is a schematic perspective view of a butt end section of the handgrip of FIG. 15.
Figure 17:
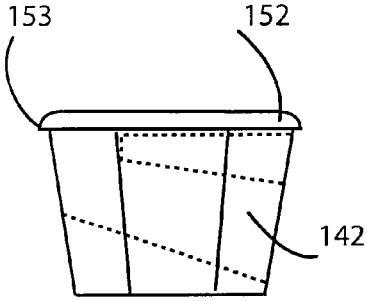
FIG. 17 is a side view of the butt end section of FIG. 16, this end section having an alignment edge for grip placement.
Figure 18:
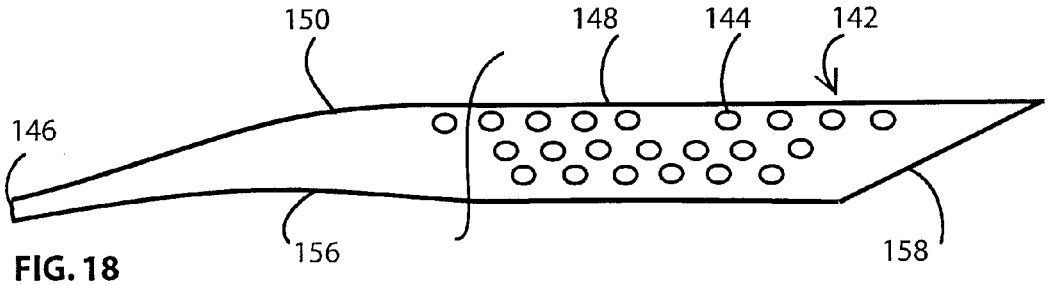
FIG. 18 is a side view of a wide flexible strip for forming a grip on a handle.
Figure 19:
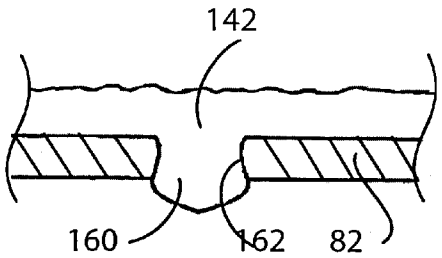
FIG. 19 is a cross-sectional detail showing a button-type connection between an outer layer of the handgrip and an inner structural layer.

FIGS. 15 to 17 are schematic illustrations showing one method for applying a flexible grip layer to one form of handgrip constructed according to the present disclosure. FIG. 15 is an end view of the butt end of the handgrip having a support layer (82). The butt end section can have a flared configuration, if desired, as clearly illustrated in FIGS. 16 and 17, this configuration helping the user to maintain a firm grip on the racquet or other striking device. Formed on one side of this flared end is a locating indentation (140) which can be formed during the molding process, for example. An elongate strip (142) that can be used to make an original or replacement grip for a handle is illustrated in FIG. 18. This strip can be formed with a number of air passages or holes (144) which will be aligned with underlying holes formed in the support structure (82). The elongate grip member (142) is formed with a blunt end at 146 and this end can be initially placed in the indentation (140), thereby ensuring that the end of the strip (142) is properly located for the grip wrapping operation. In this way, proper alignment of the holes (144) with the holes in the handle is achieved. Extending between the blunt end (146) and longitudinal edge (148) is an edge (150) which extends at an angle that accounts for the flared shape of butt end section (152) of the handgrip, in other words the edge (150) is cut so that when the strip (142) is wrapped around the butt end section, the edge (150) will align itself with the multi-sided edge (154) at the butt end of the handgrip, thereby helping to provide a finished appearance when the wrapping operation is completed. Thus by the use of the indentation (140) to properly locate the end of the grip strip (142) and by properly skiving the side edges of the grip strip, the strip can be wrapped in a manner so as to ensure that most, if not all of the holes (144) are aligned with the underlining holes in the support layer (82). It will be understood that the grip strip (142) is made sufficiently long so that it can completely wrap the sides of the shell portion of the handle including the butt end section. In one particular embodiment the width of the strip between the two longitudinal edges (148 and 156) is approximately 2 to 3 inches. The edge (158) can be formed at an acute angle to the edge (148) and is again set at an angle so as to form an even, circumferentially extending edge at its end of the shell of the handle.

As an alternative as to the use of adhesive to bond a wrapped grip (142) to the underlying structural layer, it is possible to form the flexible outer layer with button-type connectors (160) which can mechanically attach the grip layer. These connectors have an enlarged outer end and, because of the flexible elastomeric nature of the material, each button can be pushed through a respective hole (162) formed in the rigid handle structure or support layer (82). A series of the connecting holes can be formed in the support layer (82) in addition to the aforementioned air passages (22). The button connectors (160) can be used also in combination with adhesive, releasable or otherwise, provided on the inner surface of the grip strip (142).

Figure 20:
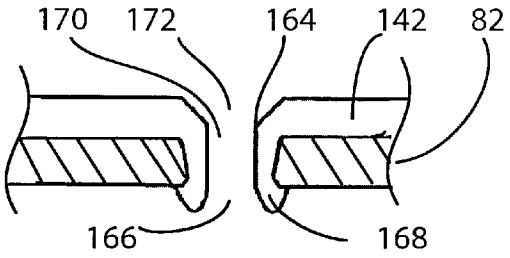
FIG. 20 is a cross-sectional detail similar to FIG. 19 but showing a button type connection with an air passage formed therein.

An alternative form of button-type connector is illustrated in FIG. 20. In this construction the button type connector (164) is formed with its own central air passage (166). Thus the connector (164) is an annular member with an outwardly projecting lip (168) that engages the structural layer (82). The illustrated passage (166) has a cylindrical central section (170) and an outwardly flared end section (172). It will be understood that in addition to the air passages (166), a plurality of the air passages (22) with no button connectors therein can also be provided in the shell of the handle.

Figure 22:
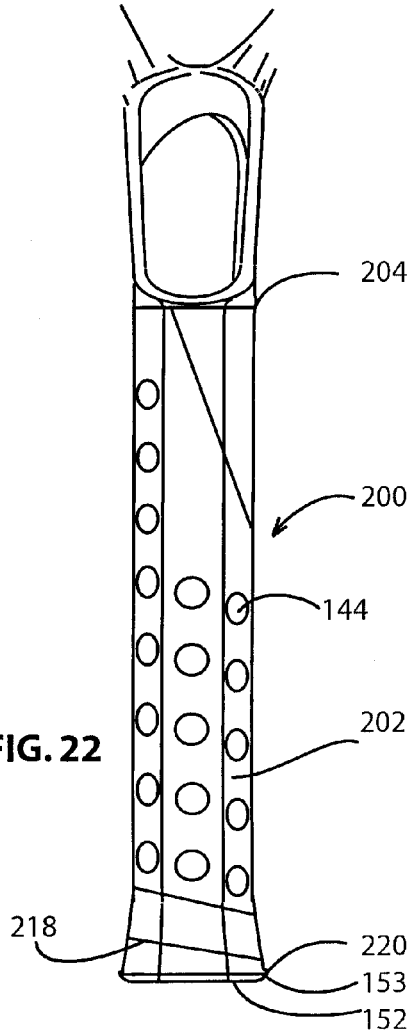
FIG. 22 is a partial front view of a racquet, this view showing the racquet handle wrapped with the flexible strip of FIG. 21.
Figure 21:
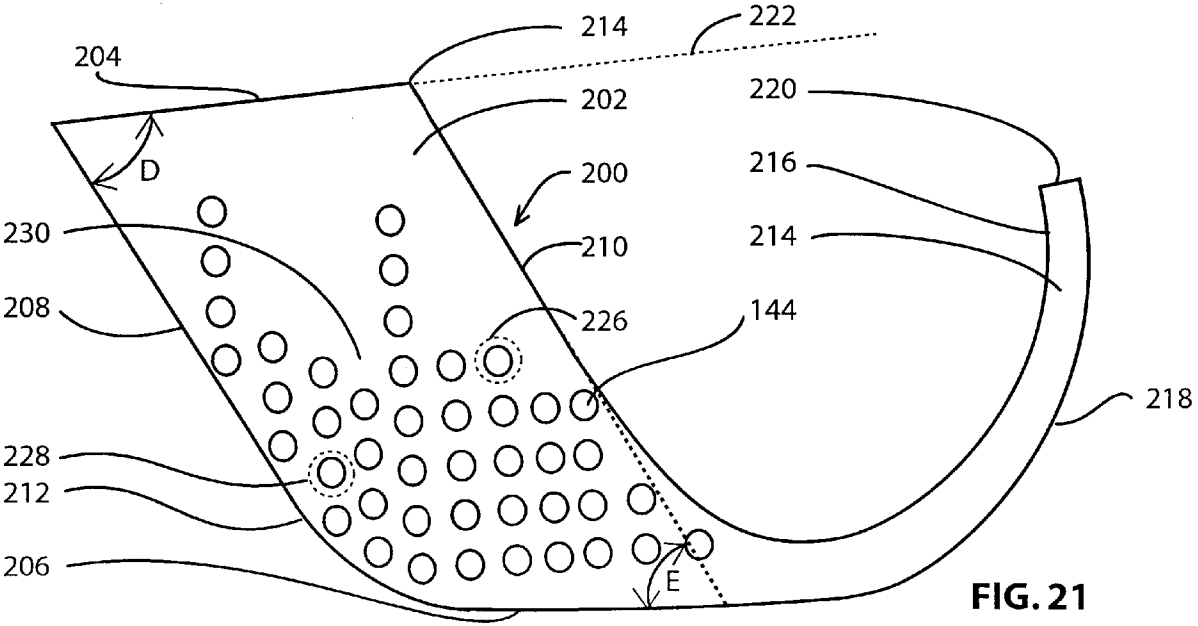
FIG. 21 is a side view of a curved strip for forming a grip on a handle.

FIG. 21 illustrates an alternate form of flexible strip (200) for forming a grip on a handle for a striking device. This alternate strip, which can be applied to the rigid, underlying structural portion of the handle in a manner similar to the flexible strip of FIG. 18, includes a major strip portion (202) having a first end edge (204) and an opposite second end edge (206). This strip portion also has a first side edge (208) and an opposite second side edge (210). The first side edge (208) extends between the first end edge (204) and the second end edge (206) and can form a convex curve (212) where the side edge meets the end edge (206). The first side edge extends at an acute angle D to the first end edge (204) and in the illustrated exemplary embodiment this angle is about 65°. The size of this acute angle can vary and is dependent to some extent on the underlying support structure of the handle. The second side edge (210) extends from one end (214) of the first end edge, a major portion of the distance between the first end edge (204) and the second end edge (206) towards the second end edge and at an acute angle thereto, this angle being indicated at E in FIG. 21. The flexible strip also includes a minor strip portion (214) connected to a corner of the major strip portion (202) located where an end of the second side edge (210) is closest to the second end edge (206). This minor strip portion has two opposite curved side edges (216) and (218) extending away from the aforementioned corner and generally parallel to one another. These side edges extend to a blunt or squared off end (220) of the strip. The side edge (218) is an outer edge that forms a convex curve and this curved edge extends from about the second end edge (206) of the major strip portion towards a straight line extension of the first end (204), this extension indicated by the dashed line at (222). This flexible strip (200) is adapted for wrapping more rapidly around a rigid, elongate handgrip having an enlarged butt end (as illustrated in FIG. 22) as compared to the wrapping of other known grip wraps. When applying the strip to the handgrip support, the minor strip portion (214) is wrapped around the butt end of the handle structure.

In the exemplary illustrated strip (200), the major strip portion (202) has a plurality of air holes (144) formed therein and distributed over a surface thereof. Again, these air holes are so arranged and placed that they will overlay and be aligned with the air holes formed in the underlying rigid layer of the shell of the handle. Also, in the illustrated strip, the major strip portion (202) is shaped generally in the form of a parallelogram, although it is possible for the two end edges (204, 206) to diverge a small amount from one another as shown. Also, in this embodiment, the minor strip portion (214) extends through an arc of at least 90° and indeed the minor strip portion extends through an arc of at least 110°.

A flexible strip having the shape or layout of the strip (200) is able to be attached to the rigid, underlying shell structure of the handle much faster and more accurately than previously known flexible strips for a handle grip. The flexible strip (200) is still placed about the rigid, structural portion of the handle in substantially the same manner as commonly used tape grips and the strip (200) is also affixed to the underlying handle structure by a suitable adhesive. However, a flexible handle grip strip of the type shown in FIG. 21 is less difficult to place and align on the rigid handle structure compared to previously known long, unwieldly tape grips which can be hard to align. Morever, the use of the fairly narrow minor strip portion (214) for wrapping around an angled butt cap or angled butt end of the handle helps to eliminate any bumps or undesirable protrusions which otherwise can be created by the transition from the angled butt end to the flat handle portion. Moreover, as indicated, a flexible wrap having the generally form of the strip 200 can readily be aligned and placed during the manufacturing process so that its holes (144) align with the air holes in the rigid shell, particularly if the rigid angled butt of the handle or a butt cap mounted on the handle is formed with or provided with the registration mark, recess or depression that indicates where the flat end (220) is to be placed and, particularly, if the butt end is formed with an edge flange (157) as shown in FIG. 17. In one exemplary version of the flexible strip (200), the strip is made with at least two different surface textures on the outer surface thereof. For example, one of these surface textures can extend over the major strip portion (202) and can be relatively rough in order to provide a handgrip which is easy to grasp in a non-slipping manner. For some handgrip applications, the flexible strip (200) forming the grip can have several different textures or qualities on the outer or top surface. One way of creating these different textures or qualities is to use differing materials which can have different absorption surfaces. For instance, the minor strip portion (214) which is wrapped around the butt end section can be formed of a material or formed with a surface that provides a smooth outer surface since this might provide more comfort for the user of the striking device or racket. On the other hand, it can be desirable to make the outer surface of the major strip portion (202) which extends about the elongate portion of the handle that is gripped by the user, rougher, bumpier or stickier than the minor strip portion as this will aid in grasping the handle, preventing slippage and possible injury to tendons or skin inflammation.

If desired, the flexible grip strip (200) can be provided with special markings or indications which can be felt with the user's hand to assist the user of the striking device, and in particular the user of the racket or paddle, to grasp the handle or grip in a particular desired location. For example, a player of a ball game such as tennis may wish to replicate a particular hand position for specific purposes, such as holding the racket to create the same type of serve (for example, a flat serve or a serve with a spin on the ball) each and every time. Also, such marks or locators on the handle grip can be desirable to position the hand for different gripping styles used in play such as the continental style or the western forehand style.

For illustrative purposes only, FIG. 21 indicates in dashed lines marking means (226, 228) on the major strip portion (202) for allowing the user of the striking device, for example the racket, to position his or her hand at a desired location on the handgrip during use of the striking device. For example, one or more of the holes (144) in the flexible strip can be color coded by color applied to the strip (200), this color coding allowing a user of the striking device to position his or her hand at a desired location on the handgrip during use of the striking device. Thus, the air hole (144) surrounded by the dashed line (226) might be circled with green ring indicated by the dashed line and the air hole circled by the dashed line at 228 can be encircled by a red ring. Alternatively, particular spots or locations on the handle grip can be indicated by a variation in the size of particular air holes 144. For example, the air holes encircled with the dashed lines at (226) and (228) can simply be made larger than the rest of the air holes and the player can then simply sense these locations on the handle by touch. Alternatively, or in addition, some of the air holes (144) can be separated by larger gaps such as the gap (230). By sensing with his or her hand this area of the grip where there are no air holes, the player can readily locate or orient the racket in a particular, desired manner. Another possible locating device that can be used in conjunction with such flexible strips is a small foam plug or other soft plug that can be placed in a particular hole in the grip as a locating or marking device. Such a plug can be made so as to simply fill a particular hole in the grip or to project slightly from the hole. Several of such plugs can be used, if desired.

Figure 23:
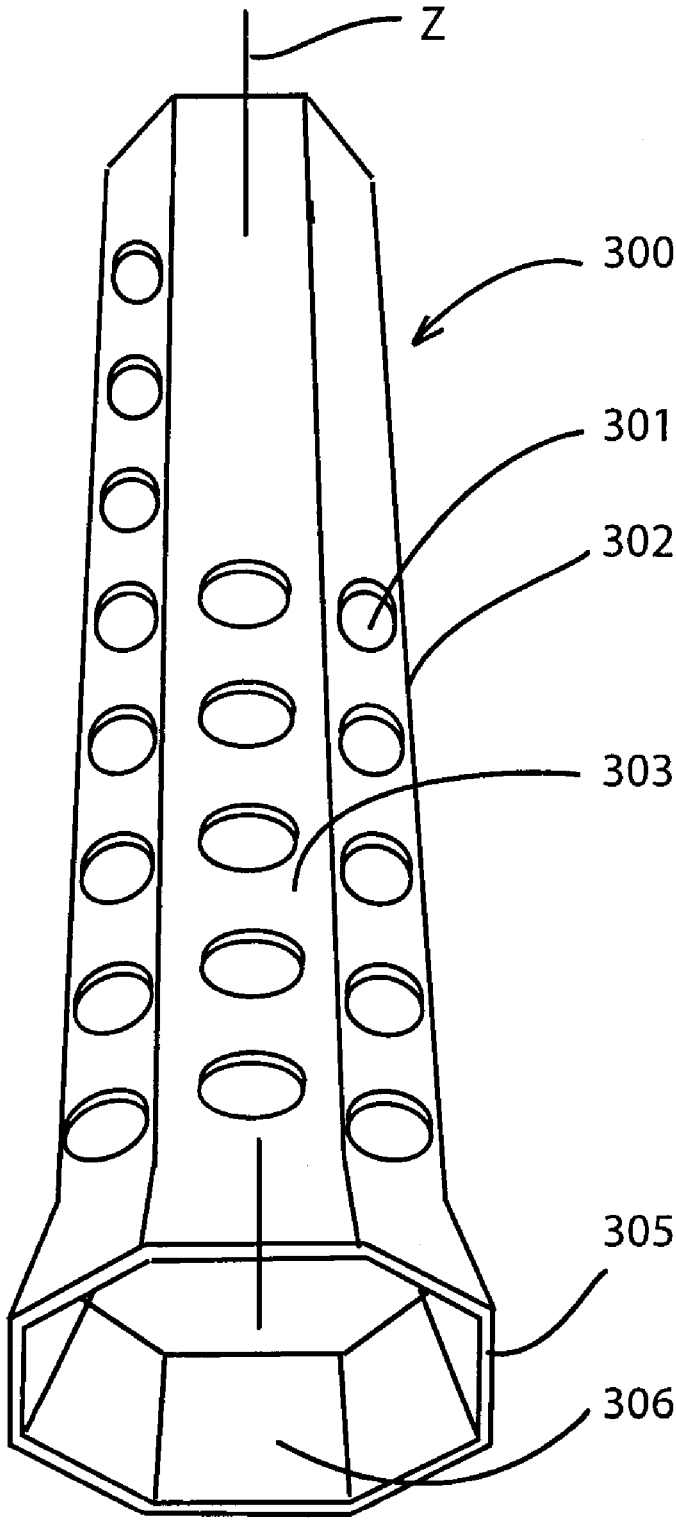
FIG. 23 is a perspective view of a tubular grip member usable on a handle is of a striking device constructed according to another embodiment of the invention.

FIG. 23 illustrates a flexible plastic grip member (300) that could be used for making an elongate handgrip of a striking device and it can be used in place of the above described flexible wrapping strips. This grip member comprises an elongate, open ended sleeve member 302 made of heat shrinkable plastics material, a type of material which is per se known in the plastics and packaging industries. This grip member can be made of a soft, foamed plastic which is still soft and pliable after the grip member has been heat shrunk. The grip member is initially sized to fit loosely around a rigid, elongate handle support such as the rigid portion of the shell (20) in the handle of FIG. 2, this rigid shell portion having an enlarged butt end. The grip member has an longitudinal central axis indicated by the line Z and extending along this axis is a main section 303 extending a major portion of the length of the sleeve member and, in the preferred embodiment shown, for most of the length of the sleeve member. As shown, this main section can be formed with eight longitudinally extending sides corresponding to sides of the underlying handle support. The grip member also has a relatively short end portion (306) which terminates at an enlarged end (305) of the grip member. The end portion (306) is formed of a circumferentially extending sleeve wall section which is an integral extension of the main section (303). The relatively short sides of the wall section, as viewed in axial cross-section of the sleeve member, each slope at an acute angle to the longitudinal central axis Z.

In order to mount the grip member (300) on the rigid handle support, it is pulled over the handle support and arranged in an appropriate position on the handle support prior to the shrinking process. In other words, it is correctly oriented both in the longitudinal direction on the handle support and in the circumferential direction so that the longitudinal sides of the handle support are aligned with the longitudinal sides of the grip member. At this time, an array of air holes (301) can already been formed in the grip member or these can be omitted from the grip member and formed therein after the shrinking process. If they are already formed in the grip member, then it is necessary to align the holes (301) with the underlying holes in the rigid support member prior to the shrinking step. The material forming the grip member can be made with various desired thicknesses and surface characteristics which are normally desired by players. The heat shrinking step can then be carried out using a standard heating process for heat shrinking plastics material and the resulting handle is provided with a pliable, exterior surface which fits tightly on the handle support and which does not require adhesive or the aforementioned button connectors to hold the pliable exterior layer in place.

If air holes have not already been formed in the grip member (300) and in the underlying rigid handle support, the air holes (301) and the aligned holes in the handle support can now be formed by a laser cutting process which is able to cut these air holes in both the grip member and the handle support in a single cutting step for each hole, thereby ensuring perfect alignment of the holes in the grip member with those in the underlying support. Laser cutting equipment of this type is already known in the laser cutting machine industry and the laser cutting machine can be guided by a computer or microprocessor in a manner known per se.

From the above description it will be appreciated that there has been disclosed herein exemplary forms of handles for a striking device that are effectively able to capture external air during use of the device and to cause an air flow into an interior chamber of the handle in order to cool and dry a user's hand and the handle structure itself. Further, in a particular exemplary embodiment, the air passages formed in the shell for ventilation are enlarged as compared to the air passages in the handle of the applicant's earlier US patent referred to above, these enlarged air passages allowing for more direct contact between the air flow through the handle and the user's hand. Also, by increasing the size of the scoop section 34 adjacent the handgrip the complete handle combination is better able to absorb the jarring impact that occurs when an object is struck. In particular, it is possible to enhance performance of the handle of the present disclosure by increasing the length of the scoop section. In this way, the remote ends of the air scoops are located further from the butt end of the handle and therefore, during use of the striking device, more external air can be pulled in by the air scoops.

While the present invention has been illustrated and described as embodied in several exemplary embodiments, ie. embodiments having particular utility as sports rackets, sports paddles and tools, it is understood that the present invention is not limited to the details shown herein, since it will be understood that various omissions, modifications, substitutions and changes in the forms and detail of these striking devices and handles for use with such devices may be made by those skilled in the art without departing in any way from the spirit and scope of the present invention. For example, those of ordinary skill in the art will readily adapt the present disclosure for various other applications without departing from the spirit or scope of the present invention.

We claim:

1. A striking device comprising a head portion for striking an object or surface and an elongate handgrip connected to said head portion, said handgrip including:

an elongate exterior shell having a central longitudinal axis, having a plurality of evenly distributed air holes for ventilation purposes and to firmly secure the user's grip thereof, and defining an elongate ventilation chamber, said air holes extending between said ventilation chamber and an exterior surface of said shell; and an air scoop section connected to a head end of said shell and forming two air inlets on opposite sides of said handgrip and on opposite sides of a central longitudinal plane, each air inlet opening into a respective air passage connected to said ventilation chamber at the head thereof, said air scoop section including a partition separating the two air inlets and the air passages and terminating at a thin partition edge at said ventilation chamber, said partition having airflow directing surfaces on opposite sides thereof which are gently concavely curved as seen in longitudinal cross-section and which, during use of and movement of said striking device, can direct outside air in a longitudinal direction of said handgrip into said ventilation chamber, each airflow directing surface having a substantially planar central section which slopes at an acute angle to said central longitudinal plane when said central section is viewed in transverse cross-section of the air scoop section, wherein the two air passages are connected by the ventilation chamber in such a manner that, when outside air enters one of said air inlets during use of the striking device, air is concurrently sucked out of the other air inlet helping to cool the handgrip.

2. A striking device according to claim 1 wherein said air scoop section includes two pairs of longitudinal side walls with each pair defining one of said air inlets and its respective air passage and wherein one side wall of each pair has a height extending perpendicular to said central longitudinal plane greater than the height of the other side wall of the pair.

3. A striking device according to claim 2 wherein an inner side of each of said side walls is concavely curved in a transverse cross-sectional plane which is perpendicular to said central longitudinal axis of the shell.

4. A striking device according to claim 1 wherein each textured airflow directing surface has a rough or bumpy surface.

5. A striking device according to claim 1 wherein said air scoop section is wider than said exterior shell both in a first transverse direction which is parallel to said central longitudinal plane and in a second transverse direction perpendicular to said central longitudinal plane, whereby said air inlets are each at least as wide as said exterior shell and project further from said central longitudinal plane than adjacent sides of the exterior shell.

6. A striking device according to claim 1 wherein said striking device is a type of racquet and said head portion is a racquet head.

7. A striking device according to claim 1 wherein said striking device is a tool selected from a group of tools comprising a hammer, a pick and a hatchet.

8. A striking device according to claim 1 wherein said exterior shell includes a flexible outer grip layer and a rigid, underlying support structure and said grip layer is wrapped around and bonded by adhesive to said support structure.

9. A striking device according to claim 8 wherein said grip layer has a plurality of push button connectors integrally formed on and distributed over an inner surface thereof and said support structure has a plurality of connection holes formed therein, said push button connectors being respectively received in said connector holes for mechanically attaching said grip layer to said support structure.

10. A striking device according to claim 1 wherein said exterior shell has first and second ends and said second end is located furthest from said head portion and is closed so that said ventilation chamber is closed at an end thereof located furthest from the air scoop section, yet may be designed to be proportionately open.

11. A hitting device for a game such as table tennis, platform tennis, or paddle ball, said paddle device having a relatively wide and substantially flat head portion extending in a first plane and an elongate, hollow handgrip connected to said head portion and having a central longitudinal axis, said handgrip comprising:

an elongate, exterior shell extending lengthwise along said central longitudinal axis, having a plurality of air holes for ventilation purposes as well as to secure the user's hand gripping ability therein distributed over an exterior surface thereof, and forming and surrounding an elongate ventilation chamber, said air holes extending between said ventilation chamber and said exterior surface; and an air scoop section extending between and rigidly connected to one end of said shell and to said head portion and forming two air inlets on opposite sides of the handgrip and on opposite sides of a central longitudinal plane which is substantially coplanar with said first plane, said air scoop section also forming two air passages connected to said ventilation chamber and extending between a respective one of said air inlets and said ventilation chamber, said air scoop section including a partition separating said air passages, terminating at a thin partition edge at said ventilation chamber, and having airflow directing surfaces on opposite sides thereof which are gently curved as seen in longitudinal cross-section and which direct outside air into said ventilation chamber during use of the device, each airflow directing surface having a substantially planar central section which slopes at an acute angle to said central longitudinal plane when said central section is viewed in transverse cross-section of the air scoop section, wherein the two air passages are connected by the ventilation chamber in such a manner that when outside air enters one of said inlets during use of the hitting device, air is concurrently sucked out of the other air inlet helping to cool the handgrip.

12. A hitting device according to claim 11 wherein said air scoop section includes two pairs of longitudinal side walls with each pair defining a respective one of said air inlets and its respective air passage and wherein one side wall of each pair has a height greater than the height of the other side wall of the pair.

13. A hitting device according to claim 12 wherein said head portion is a paddle section and said air scoop section is integrally connected to said paddle section on three sides of the air scoop section.

14. A flexible strip for forming an elongate handgrip of a striking device, said flexible strip comprising a major strip portion having opposite first and second end edges and opposite first and second side edges with said first side edge extending between said first and second end edges at an acute angle to said first end edge and said second side edge extending from one end of said first end edge a major portion of the distance between said first and second end edges towards said second end edge and at an acute angle to said second end edge, and a minor strip portion connected to a corner of said major strip portion located where an end of said second side edge is closest to said second end edge, said minor strip portion having two opposite, curved side edges extending away from said corner and generally parallel to one another, said curved side edges including a convex outer side edge that extends from about said second end edge of the major strip portion and that curves towards a straight line extension of the first end edge, wherein said flexible strip is adapted for wrapping around a rigid, elongate handgrip support having an enlarged butt end and, when applying said strip to said handgrip support, said minor strip portion is wrapped around said butt end.

15. A flexible strip according to claim 14 wherein said major strip portion has a plurality of air holes formed therein and distributed over a surface thereof, said holes greatly augmenting the security of contact by the players hand to the major strip with its plurality of holes.

16. A flexible strip according to claim 14 wherein said major strip portion is shaped generally in the form of a parallelogram and said minor strip portion extends through an arc of at least 90 degrees.

17. A flexible strip according to claim 14 which include marking push buttons on said major strip portion for allowing a user of the striking device to position his or her hand by touch at a desired repeatable location on the handgrip during use of the striking device.

18. A striking device comprising a head portion for striking an object or surface and an elongate handgrip connected to said head portion, said handgrip comprising an elongate structural handgrip member having an enlarged butt end and a flexible strip according to claim 14 wrapped around and bonded to said handgrip member so as to form a secure mechanical gripping surface.

19. A handle for a striking device used to strike an object, ball or surface, said handle comprising:

an elongate shell forming a rigid support structure having a central longitudinal axis forming an elongate ventilation chamber therein and having an enlarged butt end, and a flexible plastic grip member including an elongate, open-ended sleeve member made of heat shrinkable plastics materials which may be manufactured in a wide variety of differing surfaces, varying softness, thickness and textures, and then heat shrunk onto and extending around said shell, said sleeve member having a longitudinal central axis, a main section extending a major portion of the length of the sleeve member, and a relatively short end portion formed of a circumferentially extending sleeve wall section which, in axial cross-section of the sleeve member, slopes at an acute angle to said longitudinal central axis, wherein a plurality of air holes for ventilation purposes and added gripping ability are formed in said shell and said grip member and are distributed circumferentially and axially on said shell and said grip member, said air holes extending through a rigid layer of said support structure and said grip member.

20. A handle according to claim 19 wherein said air holes have been formed simultaneously in said rigid layer and in said grip member by a laser cutting process after said grip member, composed of variable surface textures, has been heat shrunk onto the rigid layer.

* * * * *